US005112665A

United States Patent [19]

Alexander

[11] Patent Number: 5,112,665

[45] Date of Patent: May 12, 1992

[54] WATER BARRIER OF WATER-SWELLABLE CLAY SANDWICHED BETWEEN INTERCONNECTED LAYERS OF FLEXIBLE FABRIC

[75] Inventor: William Alexander, Naperville, Ill.

[73] Assignee: American Colloid Company, Arlington Heights, Ill.

[21] Appl. No.: 732,586

[22] Filed: Jul. 19, 1991

Related U.S. Application Data

[63] Continuation of Ser. No. 481,455, Feb. 15, 1990, abandoned.

[51] Int. Cl.[5] ..... B01D 39/00; B32B 5/26; B32B 5/30

[52] U.S. Cl. ..... 428/102; 112/403; 112/405; 112/420; 112/262.1; 156/70; 156/93; 210/502.1; 210/503; 210/505; 210/908; 210/912; 428/103; 428/172; 428/192; 428/193; 428/236; 428/237; 428/239; 428/241; 428/283

[58] Field of Search ..... 112/403, 405, 420, 262.1; 156/70, 93; 428/102, 103, 172, 192, 193, 236, 237, 239, 241, 283

[56] References Cited

U.S. PATENT DOCUMENTS

| | | | |
|---|---|---|---|
| 3,445,322 | 5/1969 | Saüa et al. | 428/319.7 |
| 4,424,248 | 1/1984 | Tesch et al. | 428/172 |
| 4,495,235 | 1/1985 | Tesch | 428/231 |
| 4,530,765 | 7/1985 | Sabherwal | 210/663 |
| 4,565,468 | 1/1986 | Crawford | 428/102 |
| 4,622,260 | 11/1986 | Tesch | 428/331 |
| 4,693,923 | 9/1987 | McGroarty | 428/148 |
| 4,810,573 | 3/1989 | Harriett | 428/331 |
| 4,837,085 | 6/1989 | McGroarty | 428/337 |
| 4,849,273 | 7/1989 | Skinner et al. | 428/102 |

*Primary Examiner*—James C. Cannon

*Attorney, Agent, or Firm*—Marshall, O'Toole, Gerstein, Murray & Bicknell

[57] ABSTRACT

A multi-layer article of manufacture includes an intermediate layer of a water-swellable colloidal clay, such as bentonite, sandwiched between two layers of flexible sheet or fabric material wherein the two flexible layers of sheet or fabric material are structurally interconnected through the intermediate clay layer, such as by quilting, with threads, fibers, filaments or strands of flexible material at spaced locations over essentially the entire outer surface areas of both sheet or fabric material layers.

4 Claims, 2 Drawing Sheets

WATER BARRIER OF WATER-SWELLABLE CLAY SANDWICHED BETWEEN INTERCONNECTED LAYERS OF FLEXIBLE FABRIC

CROSS REFERENCE TO RELATED APPLICATION

This application is a continuation of application Ser. No. 07/481,455, filed Feb. 15, 1990, now abandoned.

FIELD OF THE INVENTION

The present invention is directed to a multi-layer article of manufacture useful as a waterproofing membrane for waterproofing surfaces such as soil, plaza decks, subterranean foundation surfaces and the like in the formation of waterproofed construction areas; soil structure, such as lagoons; and hazardous or toxic waste containment areas. More particularly, the present invention is directed to a multi-layer waterproofing article of manufacturing including a layer of powdered or granular water-swellable clay, such as bentonite, surrounded by contacting layers of flexible fabric materials, such as geotechnical fabrics, interconnected at spaced locations, such as by sewing or quilting with continuous flexible threads, to provide a structurally sound spacing and interconnection between the flexible fabric materials. The spacing between the two fabric layers is defined by a thickness of an intermediate layer of powdered or granular water-swellable clay material. The fabric layers are water-permeable, if not initially, by virtue of their being punctured during the manufacture of the multi-layer article of manufacture but do not require an adhesive to structurally secure the water-swellable clay to the upper and lower fabric layers.

The method of manufacture includes interconnecting the upper and lower fabric layers, such as by continuous fibers, filaments or strands of flexible material. The multi-layer article of manufacture of the present invention can maintain a relatively heavy, uniform thickness of water-swellable clay between the fabric layers without the necessity of application of adhesive on the major surfaces of the fabric layers.

In accordance with one embodiment of the present invention, the upper and lower layers of flexible sheet material initially can be sewn or quilted together very loosely with spaced, parallel fibers, filaments or strands loosely connecting upper and lower sheet materials along spaced, parallel connecting lines. Thereafter, powdered or granular water-swellable clay is blown between the two loosely interconnected sheet materials at spaced locations between the parallel interconnecting fibers, filaments or strands which are thereafter tightened to tightly secure the sheet materials to the intermediate water-swellable clay layer. Where desirable, adhesive can be applied to the edges of the article to prevent the water-swellable clay from falling out of the edges of the article. In other embodiments, water-impermeable layers can be adhered to one or both exterior surfaces of the fabric to provide additional or safety layers of impermeability.

BACKGROUND OF THE INVENTION AND PRIOR ART

Various polymers, swellable clays, and articles of manufacture have been applied to the surface of soil to provide a waterproofing layer to prevent the penetration of water and hazardous or toxic materials into the earth, and to provide lagoons, ponds and other water containment areas. Water-swellable clays, such as bentonite, have been applied directly to the soil surface and impacted in place, as disclosed in this assignee's prior U.S. Pat. No. 3,986,365. In addition, many different multi-layered articles of manufacture containing a water-swellable clay, such as bentonite, have been manufactured by adhesively securing the water-swellable clay to major interior surfaces of flexible sheet materials for application to the soil surface in abutting or overlapping relation of adjoining multi-layered articles. Examples of flexible sheet materials containing adhesively secured water-swellable clays are found in the following U.S. patents: Clem U.S. Pat. No. 4,467,015; Clem U.S. Pat. No. 4,501,788; McGroarty et al U.S. Pat. No. 4,693,923; Harriett U.S. Pat. No. 4,656,062; and Harriett U.S. Pat. No. 4,787,780.

U.K. published patent application GB 2,202,185A discloses a layer of water-swellable bentonite between flexible layers that have been needle punched together in a needle loom that secures material from a lower layer of non-woven textile material to an upper layer of non-woven textile material, and secures material from an upper non-woven textile material to the lower non-woven textile material.

Another waterproofing barrier, disclosed in Blias U.S. Pat. No. 4,344,722, is constructed in the field by applying a first flexible, water-permeable fabric layer, overlaying a thickness of water-swellable clay material and applying an overlayer of the same flexible, water-permeable fabric thereover. Other patents disclosing the use of water-impermeable layers for protecting a soil surface include British Patent Specification 1,059,363; British Patent Specification 1,029,513 and British Patent Specification 1,129,840.

While the Blias waterproofing barrier does not require the use of adhesive because the multiple layers are assembled at their final location, this at-site assembly is disadvantageous because of the increased man hours necessary to construct the barrier at the site and because of the attendant difficulty in applying a uniform thickness of the water-swellable clay over the lower fabric layer with relatively crude construction equipment.

The above disadvantages of adhesively affixing the water-swellable clay to upper and lower fabric layers over their full internal, major surface areas or assembling a multi-layer article at the site of application are overcome in accordance with the principles of the present invention, as will be described in more detail hereinafter.

It has been found that needle looming limits the types of fabrics such that at least one of the fabric layers must be a non-woven material. Needle looming also results in relatively large apertures in the fabrics so that too much of the bentonite is lost from the product during handling. Further, heavy nonwoven fabrics, together with relatively large needle punch densities results in a great number of fibrous interconnections between top and bottom fabric layers that act as water channels that channel water from one fabric layer to the other, thereby permitting the water to pass through the waterproofing membrane, by a fabric wicking action, bypassing the water-swellable clay layer.

SUMMARY OF THE INVENTION

In brief, the present invention is directed to a multilayer article of manufacture including an intermediate layer of a water-swellable colloidal clay, such as bentonite, sandwiched between two layers of flexible sheet or fabric materials wherein the two flexible layers of sheet or fabric materials are structurally interconnected to surround the intermediate clay layer, such as by sewing or quilting, with fibers, filaments or strands of flexible material at spaced locations over essentially the entire major surfaces of both sheet or fabric material layers. In accordance with one important embodiment of the present invention, the upper and lower fabric layers are interconnected by sewing or quilting to secure the upper fabric layer to the lower fabric layer. In accordance with another important embodiment of the present invention, the upper and lower layers of flexible sheet material initially can be sewn or quilted together very loosely with spaced, parallel fibers, filaments or strands loosely connecting upper and lower sheet materials along spaced, parallel connecting lines. Thereafter, powdered or granular water-swellable clay is blown between the two loosely interconnected sheet materials at spaced locations between the parallel interconnecting fibers, filaments or strands which are thereafter tightened to tightly secure the sheet materials to the intermediate water-swellable clay layer.

Accordingly, an object of the present invention is to provide a new and improved multi-layer article of manufacture including upper and lower flexible sheet or fabric materials having an intermediate layer or a water-swellable clay, wherein the upper and lower sheet or fabric layers are structurally interconnected by one or more elongated, continuous fibers, filaments or strands of flexible material without requiring an adhesive contacting the major internal surfaces of the sheet or fabric layers to provide structural integrity.

Another object of the present invention is to provide a new and improved multi-layer article of manufacture including an intermediate layer of water-swellable colloidal clay material sandwiched between contacting upper and lower layers of a water-permeable flexible sheet or fabric material, where the upper and lower sheet or fabric materials may be the same or different.

Another object of the present invention is to provide a new and improved multi-layer article of manufacture formed by loosely sewing or quilting upper and lower flexible sheet materials together; forcing, e.g. blowing, a layer of water-swellable clay material between the loosely connected sheet material layers and then tightening the loose threads, fibers, filaments or strands connecting the flexible sheet material layers together to tightly secure the sheet materials against the intermediate clay layer.

Still another object of the present invention is to provide a new and improved waterproofing membrane capable of holding water disposed above the membrane such that water permeates the membrane at a rate of $1\times10^{-7}$ cm/sec or less, wherein the membrane includes a pair of flexible sheet or fabric layers structurally interconnected with continuous threads or strands of fabric-extraneous fibers, strands or threads and having an intermediate layer of a water-swellable clay therebetween, such that the member can be manufactured as a completed multi-layer membrane in roll form, having sufficient structural integrity without requiring adhesive to maintain sufficient clay between the sheet or fabric layers during handling.

The above and other objects and advantages of the present invention will become apparent from the following detailed description of the present invention taken in conjunction with the drawings, wherein:

DETAILED DESCRIPTION OF THE PREFERRED EMBODIMENT

Figure 1:
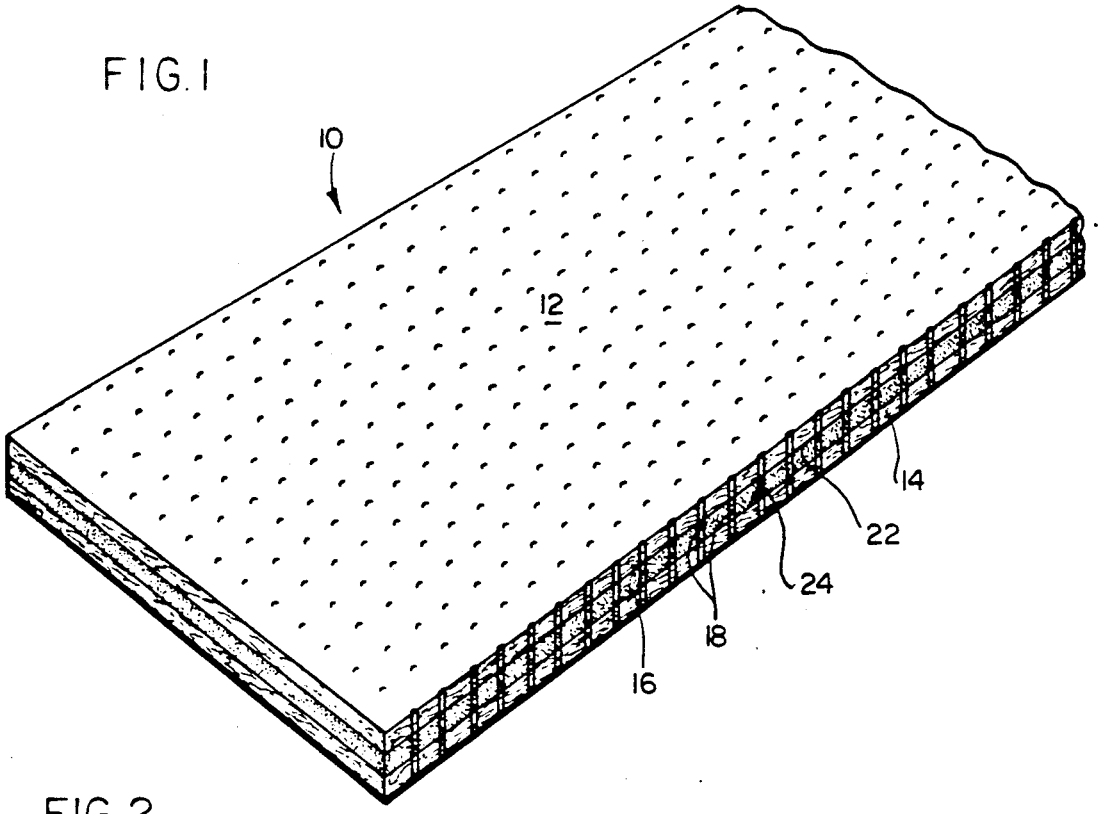
FIG. 1 is a partially broken-away perspective view of the multi-layer water barrier of the present invention.
Figure 2:
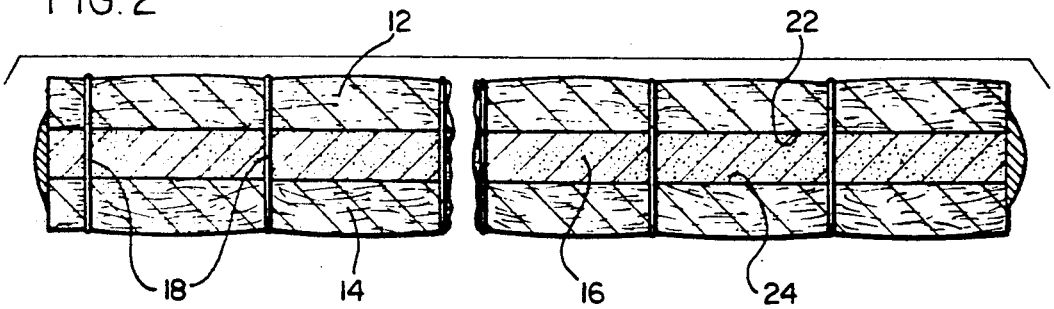
FIG. 2 is a partially broken-away perspective view of the multi-layer water barrier of the present invention, including an adhesive applied at the edges to prevent loss of water-swellable clay during handling and installation.

Turning now to the drawings, and initially to FIG. 1, there is illustrated a multi-layer article of manufacture, generally designated 10 useful as a water-proofing material including a pair of woven or non-woven flexible sheet material layers, generally designated 12 and 14, having a layer of water-swellable clay 16 sandwiched therebetween. The pair of sheet material layers 12 and 14 are structurally interconnected one to the other with continuous fibers, filaments or strands of flexible material 18 secured to both sheet material layers 12 and 14 over essentially the entire external major surfaces 22 and 24 of both sheet material layers 12 and 14. In this manner, it is unnecessary to apply an adhesive to secure the intermediate clay layer 16 to the sheet material layers 12 and 14. As shown in FIG. 2, adhesive can be applied along the edges of the multi-layer article of manufacture 10 to prevent some of the clay 16 from falling out of the edges of the multi-layer article of manufacture 10. As shown in FIG. 2, the adhesive 20 is applied between the flexible sheet material layers 12 and 14, at the edges only, to connect both flexible sheet material layers 12 and 14 to seal the edges to confine the clay 16 between the sheet material layers 12 and 14.

In accordance with an important and unexpected feature of the present invention, it has been found that the flexible sheet material layers 12 and 14 can be sewn, quilted, or otherwise secured together structurally with continuous threads, fibers, filaments or strands of flexible material at spaced intervals (e.g., 2 to 500 mil spacing) thereby avoiding the necessity of applying adhesive to the major internal surfaces 22 and 24 of the flexible sheet material layers 12 and 14, respectively. It has been found that adhesive in contact with the clay layer in some of the prior art multi-layer articles of manufacture interferes with water contact and swellability of the sandwiched clay layer 16 thereby rendering the multi-layer article somewhat inefficient. Further, it has been found that needle punching, whereby fibers from an upper non-woven sheet material layer are displaced and secured to a lower non-woven sheet material layer, and fibers from the lower non-woven sheet material layer are displaced and secured to the upper non-woven sheet material layer causes the sheet materials to become too porous on their outer surface causing substantial loss of the clay layer during handling, and excessive bleed-through of clay through the needle punched holes. When such materials are disposed against porous subterranean surfaces, e.g. sand, gravel or rocky surfaces, the clay that bleeds through the needle punched apertures can be washed away.

In accordance with another important feature of the present invention, the multi-layer article of manufacture, manufactured in accordance with the present invention, can be made with essentially no adhesive contacting the ma]or internal surfaces 22 and 24 of flexible sheet material layers 12 and 14 so that the clay layer 16 sandwiched between the flexible sheet material layers 12 and 14 will maintain complete swellability while being an article of manufacture that is sufficiently structurally sound that it can be rolled up after manufacture, as shown in FIG. 5, without substantial loss of the intermediate clay layer 16. The small holes caused by sewing or quilting, in accordance with the present invention, will be filled with water-swellable clay without substantial bleed-through should the thread or fiber used in sewing biodegrade, as with the use of a biodegradable or water-soluble fibers.

In accordance with another important and unexpected feature of the present invention, it has been found that when the flexible sheet material layers 12 and 14 are structurally interconnected with continuous threads, fibers, filaments or strands of flexible material 18, that is not displaced from the sheet material layers 12 and 14, to interconnect the flexible sheet material layers 12 and 14, the sandwiched or intermediate clay layer 16 can be provided in a greater thickness, while achieving structural integrity of the article, than if the clay were secured using an adhesive securing the intermediate clay layer 16 by adhesive contact to the major internal surfaces 22 and 24 of flexible sheet material layers 12 and 14, or by needle looming.

Figure 3:
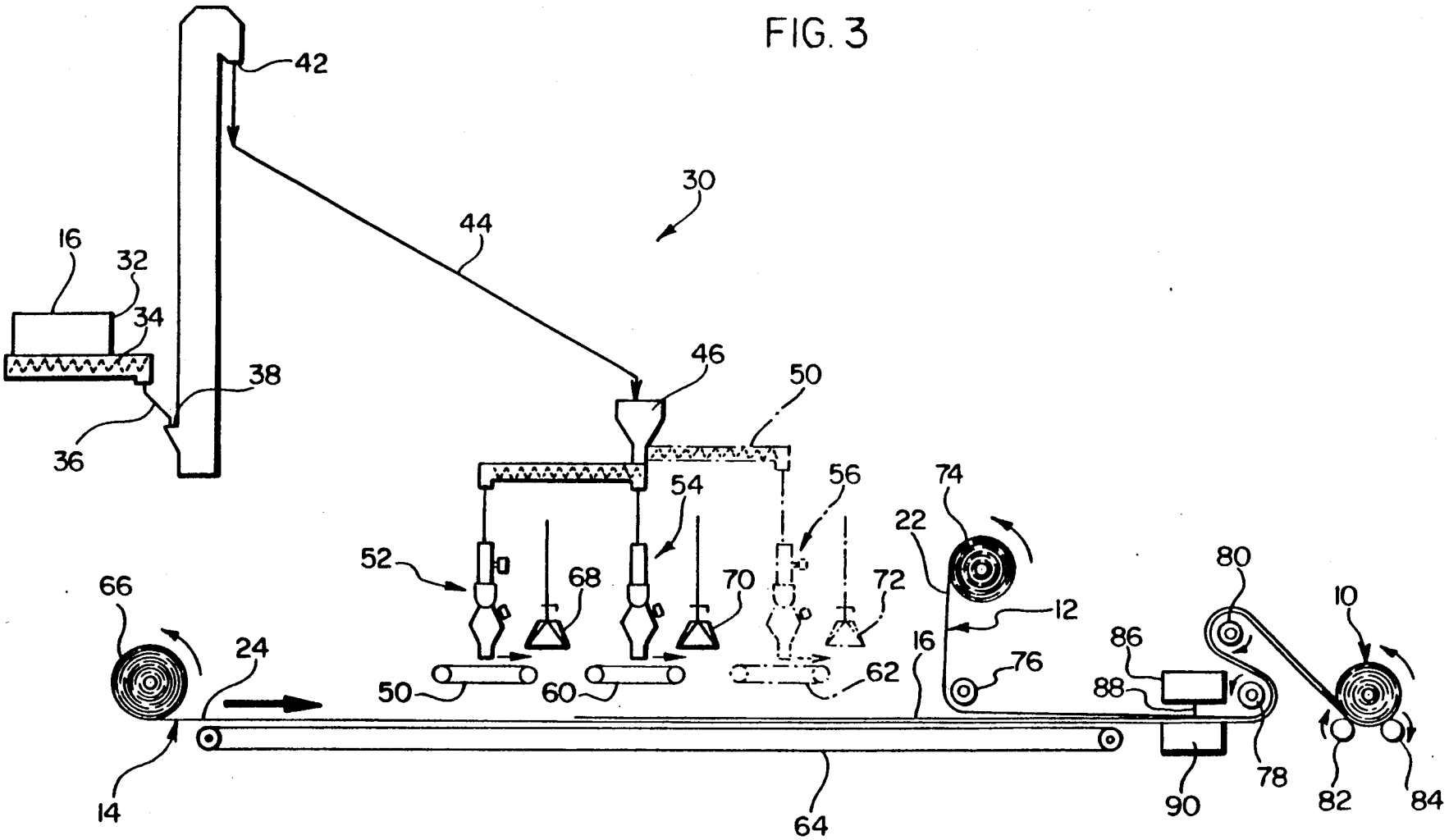
FIG. 3 is a schematic flow diagram of the manufacturing process for the water barrier of the present invention.

Turning now to FIG. 3, there is shown a schematic diagram of the method of manufacturing the multi-layered article of manufacture of the present invention, generally designated by reference numeral 30. A water-swellable colloidal clay, such as bentonite 16, is charged to a clay receiving hopper 32. An auger 34, disposed at a lower end of the receiving hopper 32 and in fluid communication therewith, forces the water-swellable clay through conduit 36 to an inlet 38 of a clay elevator 40 The water-swellable colloidal clay is discharged from the clay elevator 40 at clay elevator outlet opening 42 through conduit 44 into a clay receiving hopper 46 and a pair of augers 48 and 50 in fluid communication with the lower end of hopper 46 force the clay into one, two or three clay feeding mechanisms, generally designated by reference numerals 52, 54 and 56, for feeding the clay in a controlled manner to one, two or three continuous clay feed conveyor belts 58, 60 and 62 successively aligned above an elongated product conveyor belt 64. The clay generally is applied over a lower fabric layer 66 in an amount of about 2 to about 10 pounds per square foot of fabric surface area, preferably about 2 to about 5 pounds per square foot.

A supply of a flexible sheet material in roll form 66 is disposed above the continuous product conveyor belt 64 to provide a continuous supply of flexible sheet material onto an upper surface of the product conveyor belt 64 for receiving a layer of water-swellable clay from one, two or all three of the clay feed conveyor belts 58, 60 and 62. Any one, two or all three of the water-swellable clay feed conveyor belts 58, 60 and 62 can be used to provide one or more layers of water-swellable clay, and/or a contaminant interacting layer, onto an upper surface 24 of the flexible sheet material held on top of the product conveyor belt 64, depending upon the thickness of clay and interactant desired in the product. Dust collection suction devices 68, 70 and 72 are disposed near each continuous clay feed conveyor belt 58, 60 and 62 to clear the air of fine clay particles emanating from clay feeding mechanisms 52, 54 and 56. A second roll of flexible sheet material 74 is disposed on a downstream side of the clay feeding mechanisms 52, 54 and 56 and above the product conveyor belt 64. The second roll of flexible sheet material 74 is fed by power driven roller 76, power rollers 78 and 80 and wind up rollers 82 and 84 to dispose flexible sheet material layer 12 on top of the clay layer 16 to sandwich the clay layer 16 between lower flexible sheet material layer 14 and upper flexible sheet material layer 12.

In accordance with an important feature of the present invention, quilting device 86, as well known in the art for other purposes, such as in blanket or bedspread manufacture, is disposed above and below the multilayer article 10, at a point in the manufacturing process where the upper and lower flexible sheet material layers 12 and 14 have sandwiched the clay layer 16 therebetween, to interconnect the upper and lower sheet material layers 12 and 14 with one or more continuous, flexible threads, fibers, filaments or strands 18 of flexible material as shown by sewing needle 88 on the upper portion of the quilting device 86, above quilting platform 90.

Figure 4:
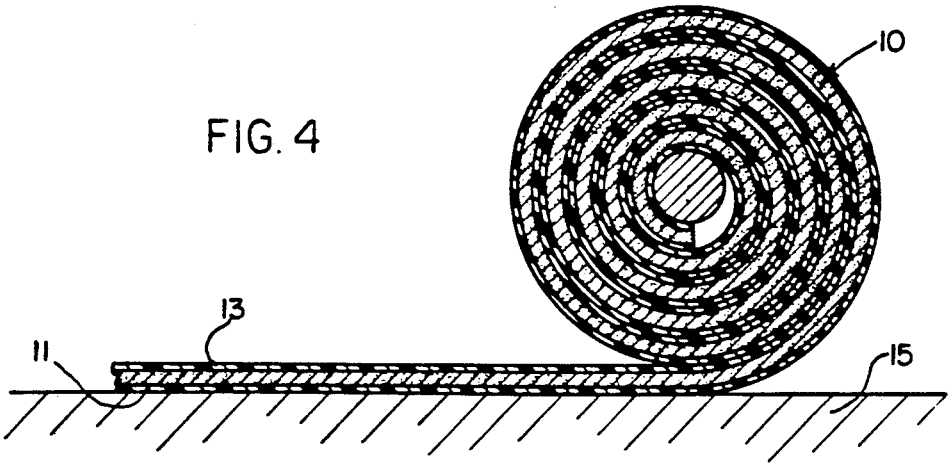
FIG. 4 is a side view of a modified water barrier, including an upper layer of another water barrier material, being installed to a plaza deck.

As shown in FIG. 4, the multi-layer article of manufacture 10 can be secured on its outer surfaces to a lower layer 11 and/or an upper layer 13 of another water-barrier material, such as a polyolefin e.g. polyethylene or polypropylene sheet material, or the polybutene or polypropene compositions disclosed in this assignee's U.S. Pat. Nos. 4,534,925; 4,534,926; and 4,668,724, hereby incorporated by reference. The composite article of FIG. 4 is particularly suitable for securing to a plaza deck 15, or other concrete, planar surfaces, and provides new and unexpected waterproofing.

In accordance with another embodiment of the present invention, the quilting device 86 is disposed upstream of a clay blowing device (not shown) to quilt sheet material layer 12 loosely to sheet material layer 14. In this manner, after the sheet materials are loosely interconnected by quilting device 86, the clay layer 16 is blown between the loosely connected sheet material layers 12 and 14 and the threads 18 are thereafter tightened to converge the sheet material layers to tightly contact the upper and lower surfaces of the clay layer 16.

The water-swellable colloidal clay utilized as the sandwiched clay layer 16 between flexible sheet material layers 12 and 14 of the multi-layered articles of the present invention is any water-swellable colloidal clay which will hydrate in the presence of water, i.e., will swell in the presence of water. In accordance with one important embodiment of the present invention, the colloidal clay is bentonite. A preferred bentonite is sodium bentonite which is basically a hydratable montmorillonite clay of the type generally found in the Black Hills region of South Dakota and Wyoming. This clay has sodium as a predominant exchange ion. However, the bentonite utilized in accordance with this embodiment of the present invention may also contain other cations such as magnesium and iron. There are cases wherein a montmorillonite predominant in calcium ions can be converted to a high swelling sodium variety through a well known process called "peptizing". The colloidal clay utilized in this invention may be one or more peptized bentonites. The colloidal clay may also be any member of the dioctahedral or trioctahedral smectite group or mixtures thereof. Examples are Beidellite, Nontronite, Hectorite and Saponite. To achieve the full advantage of the present invention, the colloidal clay, i.e., bentonite, generally is finely divided as known for use in water barrier panels and the like, i.e., 20 to 350 mesh, preferably 20 to 50 mesh.

In accordance with another important embodiment of the present invention, in addition to the water barrier characteristics of the multi-layer articles of manufacture of the present invention, the articles may be manufactured to include instead, or in addition to the water-swellable clay, the capability of removing or interacting with one or more water-soluble contaminants from the water that permeates the water-swellable clay to clarify the water that passes through the soil and into any ground water supply that might be present beneath the soil surface.

Some of the most prevalent contaminants found in waste waters contained in ponds, lagoons, areas of subteranean structure and other water-releasing areas, particularly where these areas include industrial waste waters, are heavy metal ions and water-soluble organic materials. It is well known in the prior art that natural and synthetic zeolites are capable of removing a substantial portion of the heavy metal ions from a waste water solution and that organophilic clays are capable of removing water-soluble organic materials from solution. However, the prior art suggests that removal of these materials from waste water streams should be done on stream, treating the entirety of the waste water stream in order to remove these materials, requiring frequent replacement of treating materials because of the heavy volumes of waste water stream that pass through the zeolites or pass through the organophilic clays in order to clarify these waste water streams. In accordance with an important feature of the present invention, it has been found that by including a layer of a natural or synthetic zeolite or by including a layer of an organophilic clay, with or without a layer of a water-swellable clay, such as bentonite, and/or applying a layer of the mixture of water-swellable clay with the zeolite or organophilic clay in the articles of manufacture of the present invention, the water-swellable clay will expand upon hydration and the zeolite and/or organophilic clay combined with the water-swellable clay will form a water-treatment layer wherein the zeolite and/or organophilic clay will last many times longer than it would if the entire waste water supply were treated as in the prior art with full contact of the entire volume of the waste water stream since only that quantity of water will be treated that permeates the water-swellable clay.

In accordance with another important embodiment of the present invention, the contaminant interacting layer, comprising any contaminant adsorbent, absorbent, reactant, or contaminant neutralizing material can be supplied as a separate layer below or instead of the water-swellable clay layer so that the amount of material treated for the removal of contaminants is only that material which completely penetrates the water-swellable clay layer.

In accordance with another important feature of the present invention, the contaminant removal material mixed with the water-swellable clay, or supplied as a separate layer, or included in the article of manufacture instead of the clay layer, can be any material capable of adsorbing, absorbing, reacting with for insolubilization or for neutralization, while keeping the contaminant water-soluble in order to substantially lessen or remove the contaminant characteristics of the contaminants originally present in the water contacting the article of manufacture. Examples of materials capable of removing or neutralizing contaminants that are present in the water include absorbent fibers, such as microcrystalline cellulose; attapulgite clay; zinc rincinoleate absorbed on an absorbent fiber or other absorbent material; amorphous silica powder; synthetic calcium silicate; polyolesin pulp; sodium alumino-silicate (type A sodium zeolite); multodextran; sodium silica aluminates (note that all the above are absorbents). Other materials, such as adsorbents include microcrystalline cellulose; silica hydrogel based compositions; attapulgites; synthetic sodium magnesium silicates; synthetic calcium silicates; silicon dioxide; acid activated clays; type A sodium zeolites; and the like provided as a separate layer or mixed with the absorbents and/or adsorbents. Other additives can be included such as an algicide, antimicrobial material, bactericide, disinfectant, and/or fungicides such as phenol; zinc undecylenate N.F.: acetyl tyridinium chloride N.F.X.III and the like.

Most preferred as the adsorbent, absorbent and/or reactant and/or neutralizing material are natural or synthetic zeolites and/or an organophilic clay which is basically a montmorillonite clay that has been reacted with a quaternary material to make it hydrophilic and absorbent to organic contaminants.

The flexible sheet materials 12 and 14 are, for example, geotechnical fabrics. Any suitable fabrics can be used for this purpose, particularly since the fabrics have no water-impermeability purpose other than to achieve proper installation of clay layer 16. Suitable fabrics include woven and non-woven permeable and non-permeable fabrics made from polypropylene, polyesters, nylon, propylene-ethylene copolymers, polypropylene-polyamide copolymers, and the like. The geotechnical fabrics are preferred for their bacteriological and chemical resistance but the fabrics can be biodegradable since, once positioned, the fabrics have no importance. The thickness of the fabric is not important and such fabrics generally are available in thicknesses of about 3 to about 30 mils.

Permanent threads 18 can be formed of cellulosic fibers, polyester fibers, polyalkylenes such as polyethylenes, polypropylenes and acrylic polymers or copolymers, and the like.

Water-soluble or biodegradable threads 18 are, for example, made from lightly cross-linked polyacrylates having a weight average molecular weight below about 10,000, preferably below about 5,000 so that the threads 18 will solubilize upon water contact.

It should be understood that the present disclosure has been made only by way of preferred embodiment and that numerous changes in details of construction, combination and arrangement of parts can be resorted to without departing from the spirit and scope of the invention as hereunder claimed.

What is claimed is:

1. A multi-layer article of manufacture useful as a waterproofing material comprising a pair of flexible sheet material layers having a layer of a water-swellable clay sandwiched therebetween, said pair of sheet material layers structurally interconnected by sewing one to the other with continuous, elongated fabric-extraneous fibers at spaced intervals over essentially the entire major external surfaces of both sheet material layers to confine the clay therebetween, and further including a layer of flexible water-impermeable material substantially coextensive with and adhered to one of the sheet material layers.

2. The article of claim 1 wherein the layer of water-impermeable material is a polymeric sheet material adhesively secured to the upper flexible sheet material layer.

3. The article of claim 1 wherein the layer of water-impermeable material is a mixture of a water-swellable clay and polypropene or polybutene as a cohesive, sticky layer.

4. The article of claim 1 wherein both of the sheet material layers are woven fabric layers.

* * * * *